US009494073B2

(12) United States Patent
Steinert

(10) Patent No.: US 9,494,073 B2
(45) Date of Patent: Nov. 15, 2016

(54) METHOD AND DEVICE FOR MONITORING THE FUNCTION OF AN EXHAUST-GAS SENSOR

(75) Inventor: Thomas Steinert, Weinstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 98 days.

(21) Appl. No.: 13/825,931

(22) PCT Filed: Sep. 7, 2011

(86) PCT No.: PCT/EP2011/065467

§ 371 (c)(1),
(2), (4) Date: Jun. 21, 2013

(87) PCT Pub. No.: WO2012/038256

PCT Pub. Date: Mar. 29, 2012

(65) Prior Publication Data

US 2013/0269316 A1 Oct. 17, 2013

(30) Foreign Application Priority Data

Sep. 24, 2010 (DE) ..... 10 2010 041 311

(51) Int. Cl.

*F01N 3/00* (2006.01)
*F01N 3/02* (2006.01)
*F01N 3/10* (2006.01)
(Continued)

(52) U.S. Cl.

CPC ..... *F01N 11/00* (2013.01); *F02D 41/1495* (2013.01); *F02D 41/2441* (2013.01); *F02D 41/2474* (2013.01); *F02D 41/123* (2013.01)

(58) Field of Classification Search

USPC ..... 60/272–324
See application file for complete search history.

(56) References Cited

U.S. PATENT DOCUMENTS 5,216,882 A * 6/1993 Kuroda et al. ..... 60/276
5,533,332 A * 7/1996 Uchikawa ..... 60/274
(Continued)

FOREIGN PATENT DOCUMENTS

CN 101289966 10/2008
EP 0 650 033 4/1995
(Continued)

OTHER PUBLICATIONS

International Search Report, PCT International Application No. PCT/EP2011/065467, dated Nov. 29, 2011.

*Primary Examiner* — Audrey K Bradley
*Assistant Examiner* — Dapinder Singh
(74) *Attorney, Agent, or Firm* — Norton Rose Fulbright US LLP; Gerard Messina

(57) ABSTRACT

A method for monitoring the function of an exhaust-gas sensor in the exhaust duct of an internal combustion engine. A first function control of the exhaust-gas sensor takes place in a first operating point of the internal combustion engine, and in the case of an intact exhaust-gas sensor, the output signal of the exhaust gas sensor or a characteristic quantity derived therefrom is determined in at least one second operating point of the internal combustion engine in the case of an intact exhaust-gas sensor and stored as learned value, and the monitoring of the function of the exhaust-gas sensor during a subsequent operation of the internal combustion engine in the second operating point takes place by comparing the output signal of the exhaust-gas sensor or the characteristic quantity derived therefrom, with the learned value. A corresponding device for implementing the method is also described.

13 Claims, 2 Drawing Sheets

(51) Int. Cl.

| | |
|---|---|
| ***F01N 3/20*** | (2006.01) |
| ***F01N 11/00*** | (2006.01) |
| ***F02D 41/14*** | (2006.01) |
| ***F02D 41/24*** | (2006.01) |
| *F02D 41/12* | (2006.01) |

(56) References Cited

U.S. PATENT DOCUMENTS

| | | | | |
|---|---|---|---|---|
| 5,568,725 | A * | 10/1996 | Uchikawa | 60/274 |
| 5,617,337 | A | 4/1997 | Eidler et al. | |
| 5,672,817 | A * | 9/1997 | Sagisaka et al. | 73/114.72 |
| 6,711,892 | B2 * | 3/2004 | Tamura et al. | 60/277 |
| 6,925,796 | B2 * | 8/2005 | Nieuwstadt et al. | 60/277 |
| 7,444,235 | B2 * | 10/2008 | Anilovich et al. | 701/114 |
| 2003/0115854 | A1 * | 6/2003 | Tamura et al. | 60/277 |
| 2003/0221682 | A1 | 12/2003 | Surnilla | |
| 2005/0103000 | A1 * | 5/2005 | Nieuwstadt et al. | 60/286 |
| 2006/0260295 | A1 | 11/2006 | Gielen | |
| 2007/0149349 | A1 | 6/2007 | Utsumi et al. | |
| 2008/0184695 | A1 * | 8/2008 | Anilovich et al. | 60/274 |

FOREIGN PATENT DOCUMENTS

| | | |
|---|---|---|
| EP | 0 909 888 | 4/1999 |
| EP | 1 724 458 | 11/2006 |
| JP | 62 250351 | 10/1987 |

* cited by examiner

METHOD AND DEVICE FOR MONITORING THE FUNCTION OF AN EXHAUST-GAS SENSOR

FIELD

The present invention relates to a method for monitoring the function of an exhaust-gas sensor in the exhaust duct of an internal combustion engine.

In addition, the present invention relates to a corresponding device for monitoring an exhaust-gas sensor in an exhaust duct of an internal combustion engine, which has a control unit, assigned to the internal combustion engine and the exhaust-gas sensor, for controlling the internal combustion engine and for analyzing the output signals of the exhaust-gas sensor.

BACKGROUND INFORMATION

Exhaust-gas sensors featuring various designs are currently used for monitoring the emissions of internal combustion engines. To ensure this function, the exhaust-gas sensors must be checked at regular intervals, e.g., within the framework of an on-board diagnosis (OBD), with regard to their proper functioning. Specific operating states of the internal combustion engine need to be present in order to implement a few of the diagnostic functions required in this context. For example, the plausibility check of a measured oxygen concentration is carried out by a wideband lambda oxygen sensor, preferably during trailing-throttle operation of the internal combustion engine when no fuel is supplied to the internal combustion engine, since the deviation of the sensor signal from an expected value in the event of an error is highest under these circumstances.

Within the framework of new operating strategies for internal combustion engines and new technologies, the operating points of the internal combustion engine required to monitor the functioning of the exhaust-gas sensors are no longer activated at sufficient frequency. In the case of motor vehicles operated according to the start-stop method, for example, the internal combustion engine is switched off at standstill, so that the idling operating state is no longer present or present only very infrequently. In new technologies such as the hybrid drive, trailing-throttle operation is prevented for the most part.

In addition to monitoring the exhaust-gas sensors, learning functions for the different exhaust-gas sensors must be provided at certain intervals, e.g., a trailing-throttle adaptation in the case of wideband lambda oxygen sensors. The required operating state, such as trailing-throttle operation in the example mentioned, is called up separately for this purpose, even in the case of hybrid vehicles or start-stop systems. Simultaneously with these learning functions, the required diagnosis functions for the exhaust-gas sensors may be carried out as well. However, the implementation of the diagnosis function is restricted to the duration of the learning function and the frequency at which it is carried out.

It is an object of the present invention to provide an example method by which the proper functioning of exhaust-gas sensors is able to be monitored even if the operating points of the internal combustion engines required for this purpose are activated only infrequently.

It is a further object of the present invention to provide a corresponding device for implementing the method.

SUMMARY

In accordance with the example embodiment of the present invention, a first function control of the exhaust-gas sensor takes place in a first operating point of the internal combustion engine, and if the exhaust-gas sensor is intact, the output signal of the exhaust-gas sensor, or a characteristic quantity derived therefrom, is determined in at least one second operating point of the internal combustion engine and stored as learned value, and the monitoring of the function of the exhaust-gas sensor during a later operation of the internal combustion engine takes place in the second operating point, by comparing the output signal from the exhaust-gas sensor or the characteristic quantity derived therefrom, with the learned value.

The first function control takes place in an operating point of the internal combustion engine which is suitable for monitoring the function of the exhaust-gas sensor, yet is rarely activated. In the process, it is possible to determine in reliable manner whether the exhaust-gas sensor is operating properly. In a checked, functioning exhaust-gas sensor, a second, more frequently activated operating point of the internal combustion engine is activated subsequently in a selective manner, or it is activated during normal operation of the internal combustion engine, and the learned value is detected in this operating point. The learned value is the output signal of the exhaust-gas sensor in the second operating point, or a characteristic quantity derived therefrom. In the subsequent operation of the internal combustion engine, the function of the exhaust-gas sensor is then able to be monitored during the frequently encountered operating phases in the second operating point, and thus with sufficient frequency. For this purpose the output signal of the exhaust-gas sensor then present, or the characteristic quantity derived therefrom, is compared to the learned value. The learned values may be detected for a second operating point or for any other number of additional operating points, so that sufficiently frequent monitoring of the function of the exhaust-gas sensor is able to be ensured.

The advantage of comparing the current actual value of the output signal, or the characteristic quantity derived therefrom, in the second operating point to the previously determined learned value is that only changes in relation to the initial state have to be detected and monitored. The overall tolerance of the system need not be taken into account, thereby allowing monitoring of the function of the exhaust-gas sensor outside the more suitable first operating point in the first place.

A simple comparison of the actual value of the output signal of the exhaust-gas sensor or the characteristic quantity derived therefrom, with the learned value is made possible by assigning an upper and a lower threshold value to the learned value and by inferring a faulty exhaust-gas sensor if the output signal of the exhaust-gas sensor or the characteristic quantity derived therefrom exceeds the upper threshold value or drops below the lower threshold value during monitoring. When inputting the threshold values, both measuring inaccuracies in determining the output signal of the exhaust-gas sensor and in determining the operating point, as well as permitted changes in the output signal of the exhaust-gas sensor, e.g., due to allowable ageing of the exhaust-gas sensor, may be taken into account.

An error diagnosis pointing to a defective exhaust-gas sensor based on an individual faulty measurement is able to be avoided if a faulty exhaust-gas sensor is inferred when a faulty exhaust-gas sensor is detected repeatedly in successive monitoring phases.

To be able to detect malfunctions of the exhaust-gas sensor in reliable manner, it may be provided that an operating state of the internal combustion engine which is activated frequently and/or which is activated for a sufficient length of time to monitor the exhaust-gas sensor and/or during which the exhaust gas sensor exhibits large deviations at a detectable malfunction is selected as second operating point.

The second operating point is able to be specified unambiguously in that the second operating point of the internal combustion engine is defined by an engine speed or an injection quantity or an air mass or an exhaust-gas recirculation state, either considered individually or in a combination of the variables in each case.

According to a preferred refinement variant of the present invention, it may be provided that the internal combustion engine is operated in trailing-throttle operation in the first operating point, and/or that the internal combustion engine is operated under a partial load in the second operating point. The trailing-throttle operation allows an absolute check of different exhaust-gas sensors, e.g., of wideband lambda oxygen sensors, inasmuch as no fuel is supplied to the internal combustion engine in this case, the operating point is described unequivocally, and a sufficiently precise measurement of the sensor signal is able to be carried out for a comparison with an input value to be determined unequivocally. Since the internal combustion engine is operated predominantly at partial load, a check of the function of the exhaust-gas sensor in the second operating point is able to take place with sufficient frequency. The tolerances for an absolute check of the exhaust-gas sensor under partial load are too high; however, the relative evaluation by the comparison with the previously determined learned value according to the present invention allows the reliable detection of malfunctions of the exhaust-gas sensors even in partial loading.

Depending on the operating strategy for the internal combustion engine as well as new technologies, e.g., the operation of the internal combustion engine according to a start-stop method or the use in a hybrid drive, certain operating points are no longer activated except for implementing learning functions for the different sensors that are used. These operating points are no longer present during normal operation of the internal combustion engine. In order to allow first-function monitoring of the exhaust-gas sensor nevertheless, it may be provided that the first function control of the exhaust-gas sensor takes place during an operating phase of the internal combustion engine which is requested for implementing a learning function for the exhaust-gas sensor or a further sensor.

In accordance with an example embodiment of the present invention, a first program sequence is provided in the control unit, which controls a first operating point of the internal combustion engine and implements a first function control of the exhaust-gas sensor during the first operating point, and if the exhaust-gas sensor is intact, controls at least one second operating point of the internal combustion engine and detects the output signal of the exhaust-gas sensor, or a characteristic quantity derived therefrom, and stores it in the control unit as learned value, and in that a second program sequence is provided in the control unit, which implements the monitoring of the function of the exhaust-gas sensor during a subsequent operation of the internal combustion engine in the second operating point by comparing the output signal of the exhaust-gas sensor or the characteristic quantity derived therefrom, with the learned value.

To begin with, the first program sequence allows monitoring of the function of the exhaust-gas sensor according to conventional methods, so that it is possible to reliably infer a fault-free exhaust-gas sensor for the subsequently scheduled determination of the learned values. Toward this end, a first operating point, which is rarely activated and which allows an unambiguous evaluation of the operativeness of the exhaust-gas sensor, is activated.

The incorporation of the learned value takes place by determining the output signal of the exhaust-gas sensor or a characteristic quantity derived therefrom, in a second, more frequently activated operating point of the internal combustion engine. Since the learned value is determined for the current system, tolerances which prevent a prediction of the learned value without a direct measurement or the transmission of the learned value from one system to another, are negligible. Using the second program sequence, it is therefore possible to verify the operativeness of the exhaust-gas sensor in the second, frequently activated operating point of the internal combustion engine by comparing the current output signal or a characteristic quantity derived therefrom, to the learned value. This has the advantage that the functions are able to be implemented in a cost-effective manner purely through a software expansion of the control unit, utilizing existing processor and memory units.

The method and the device are preferably usable for monitoring a lambda oxygen sensor.

In addition, the method and the device are preferably usable for monitoring an exhaust-gas sensor in the exhaust duct of an internal combustion engine operated in start-stop operation, or in an internal combustion engine used in a hybrid vehicle.

The present invention is explained in greater detail below with reference to an exemplary embodiment shown in the figures.

DETAILED DESCRIPTION OF EXAMPLE EMBODIMENTS

Figure 1:
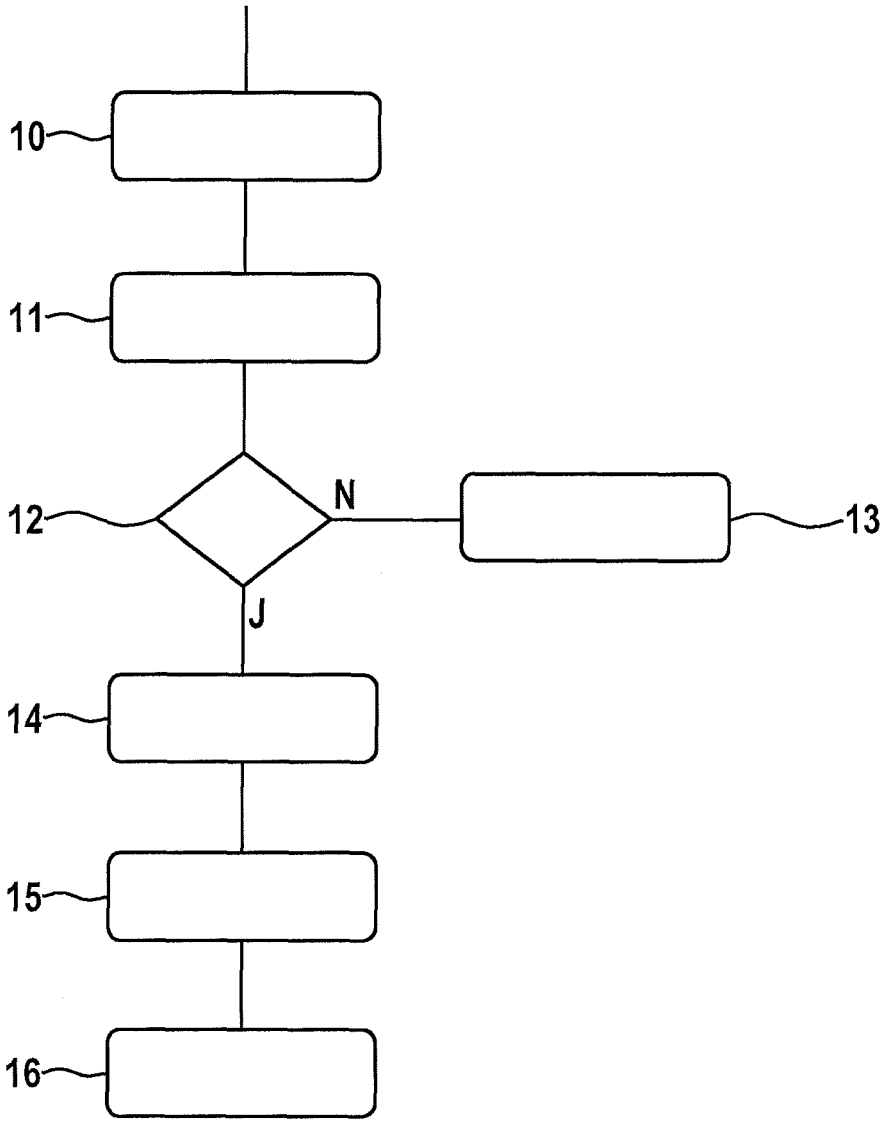
FIG. 1 shows a first flow chart of a first program sequence for determining learned values.

FIG. 1 shows a first flow chart of a first program sequence for determining learned values for monitoring the function of an exhaust-gas sensor implemented as wideband lambda oxygen sensor. The first program sequence is stored in a control unit (not shown) assigned to an internal combustion engine, the internal combustion engine constituting part of a hybrid drive.

In a first function block 10, the internal combustion engine is operated in trailing-throttle operation. The trailing throttle operation is not provided during regular operation of the internal combustion engine and is requested separately in order to implement a trailing-throttle adaptation of the wideband lambda oxygen sensor. In addition to the trailing-throttle adaptation, a first function control of the wideband lambda oxygen sensor in a second function block 11 takes place during the trailing-throttle operation which is suitable for the function control of wideband lambda oxygen sensors. In a first query 12, using the first function control, a decision is made as to whether the wideband lambda oxygen sensor is operating correctly. If this is not the case, the sequence branches to a third function block 13, and a corresponding error report is output. In the case of an intact wideband lambda oxygen sensor, first query 12 is followed by a fourth function block 14. In fourth function block 14, the internal combustion engine is operated in a second operating point, under partial load. The second operating point may be activated in selective manner or be detected during regular operation of the internal combustion engine. It may be defined by the engine speed, the injection quantity, the air mass and the exhaust recirculation state. If the second operating point is present, the output signal of the wideband lambda oxygen sensor is determined in a fifth function block 15, and the lambda value determined therefrom is stored in a sixth function block 16 as learned value for the second operating point.

Figure 2:
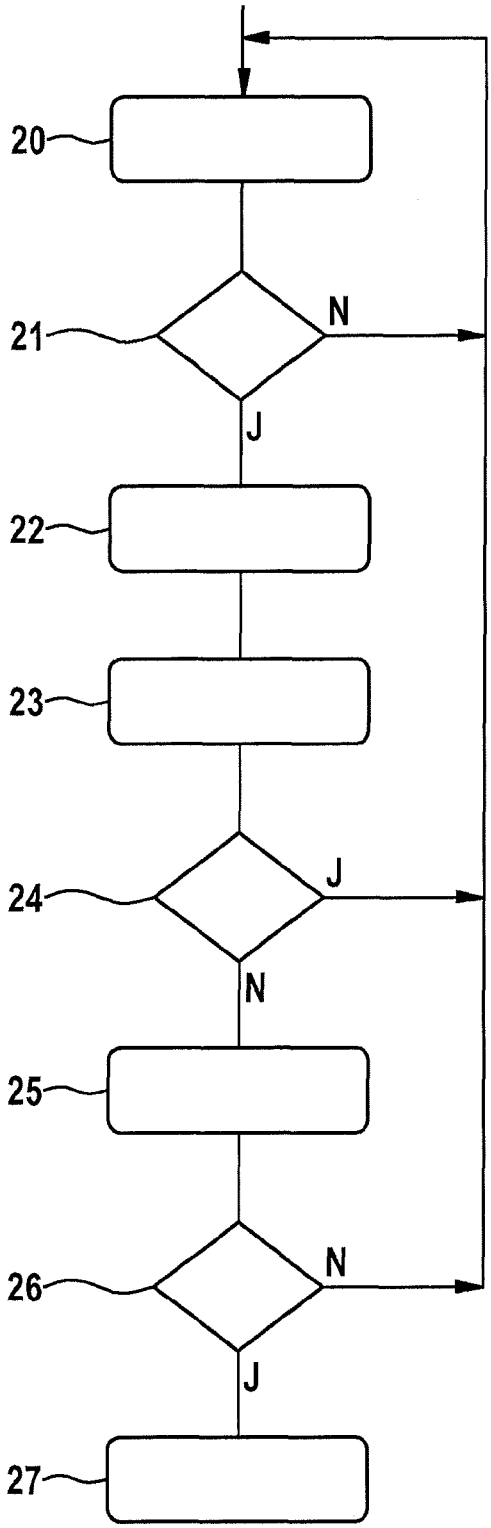
FIG. 2 shows a second flow chart of a second program sequence for monitoring the function of an exhaust-gas sensor.

FIG. 2 shows a second flow diagram of a second program sequence for monitoring the function of the exhaust-gas sensor implemented as wideband lambda oxygen sensor in the technical environment described in connection with FIG. 1. The second program sequence is also stored in the control unit. The second program sequence is activated when the learned values for the second operating point have been determined by the first program sequence described in FIG. 1.

In a seventh function block 20, the internal combustion engine is operated in regular mode. Via a second query 21, it is checked whether the second operating point is present. If this is not the case, the internal combustion engine continues to be operated in regular mode.

If it is determined in second query 21 that the second operating point is present, the output signal of the wideband lambda oxygen sensor is detected in an eighth function block 22 and the output signal is converted into a lambda value. In a ninth function block 23, the actual value of the lambda value determined in this manner is compared to the learned value, determined in the first program sequence, for the second operating point. In a third query 24, it is checked whether the actual value of the lambda value lies within a predefined tolerance range around the learned value. If this is the case, an intact wideband lambda oxygen sensor is inferred and the sequence returns to the point before seventh function block.

If the actual value of the lambda value lies outside the tolerance range around the learned value, a defective wideband lambda oxygen sensor is assumed. To increase the reliability of such a conclusion and to avoid erroneous fault reports, first a counter is incremented by an increment in a tenth function block 25. In a fourth query 26, it is queried whether the counter has reached a predefined value N. If this is not the case, the sequence returns to the point before the seventh function block 20. If, on the other hand, the counter has indeed reached the predefined value N, i.e., if a deviation of the actual value of the lambda value from the learned value outside the permissible tolerance has been detected repeatedly, a defective wideband lambda oxygen sensor is inferred. In an eleventh function block 27, the wideband lambda oxygen sensor is diagnosed as defective and a corresponding error report occurs.

The sequence is shown in FIGS. 1 and 2 by way of example for monitoring the function of a wideband lambda oxygen sensor; however, it may be used analogously for other exhaust-gas sensors whose function monitoring preferably takes place in operating points of the internal combustion engine that are activated only infrequently. The monitoring of the function of the individual exhaust-gas sensor may take place in one or in a plurality of operating point(s), for which purpose the learned values for the different operating points must then be determined in the first program sequence.

In the case of the wideband lambda oxygen sensor, for example, a load drop at the balancing line is able to be monitored. Such a load drop leads to a multiplicative error on the oxygen concentration signal of the wideband lambda oxygen sensor. The relative error is independent of the oxygen concentration to be measured. The absolute deviation from the expected output signal of the wideband lambda oxygen sensor is greatest in trailing-throttle operation. According to conventional methods, this error is therefore monitored by monitoring the signal range of the output signal in trailing-throttle operation of the internal combustion engine or by a plausibility check of the output signal with respect to a calculated signal in trailing-throttle operation.

In the case of hybrid drives, it is provided that the trailing-throttle operation is assumed only in response to a request by a learning function for the wideband lambda oxygen sensor. This means that the diagnosis frequency is reduced considerably. A load drop at the compensation line, however, has a great effect on the output signal of the wideband lambda oxygen sensor. To monitor this error, a check takes place as to whether the wideband lambda oxygen sensor is functioning properly, this check taking place in a phase in which a trailing-throttle operation is assumed. If it may be reliably assumed that the wideband lambda oxygen sensor is operating in faultfree manner, learned values for the oxygen concentration are recorded in one or additional operating point(s) under partial loading of the internal combustion engine. The output signal of the wideband lambda oxygen sensor or the lambda value formed therefrom is used as learned value. Thus, a vehicle- and sensor-specific learned value is determined for a specified operating point. In the further course of the drive cycle, when no further trailing-throttle operation is assumed, compliance with this learned value is monitored by the monitoring function in the second program sequence. If the actual value of the output signal or the lambda value formed therefrom deviates from the learned value, a defective wideband lambda oxygen sensor may be inferred.

What is claimed is:

1. A method for inferring, using a control unit including a processor and a memory, a faulty or properly functioning exhaust-gas sensor in an exhaust duct of an internal combustion engine, the method comprising:

operating, via the control unit, the internal combustion engine in a first operating point, wherein the internal combustion engine is operated in a trailing-throttle operation, and wherein the trailing throttle operation is not provided during regular operation of the internal combustion engine and is requested separately to implement a trailing-throttle adaptation of the exhaust gas sensor, which is a wideband lambda oxygen sensor;

performing a first function control of the wideband lambda oxygen sensor during the trailing-throttle operation which is suitable for functionally controlling the wideband lambda oxygen sensor;

monitoring, via the control unit, the exhaust-gas sensor in the first operating point;

determining, via the control unit in the first function control, whether the exhaust-gas sensor is operating properly in the first operating point;

if it is determined that the exhaust gas sensor is operating properly, operating, via the control unit, the internal combustion engine under partial load in at least one second operating point, wherein the second operating point is activated in a selective manner or is detected during regular operation of the internal combustion engine;

monitoring, via the control unit, the exhaust-gas sensor in the at least one second operating point, if the exhaust-gas sensor is operating properly;

determining and storing, via the control unit, as a learned value, an output signal of the exhaust-gas sensor or a characteristic quantity derived therefrom in the at least one second operating point;

assigning, via the control unit, an upper and a lower threshold value to the learned value;

comparing, via the control unit, the output signal of the exhaust-gas sensor or the characteristic quantity derived therefrom to the learned value during a subsequent operation of the internal combustion engine in the second operating point; and inferring, via the control unit, a faulty exhaust-gas sensor if the output signal of the exhaust-gas sensor or the characteristic quantity derived therefrom exceeds the upper threshold value or drops below the lower threshold value.

2. The method as recited in claim 1, wherein a faulty exhaust-gas sensor is inferred if a faulty exhaust-gas sensor is detected repeatedly in successive monitoring phases.

3. The method as recited in claim 1, wherein at least one of: i) an operating state of the internal combustion engine which is activated frequently is selected as the second operating point, ii) an operating state of the internal combustion engine which is activated for a sufficiently long period of time to monitor the exhaust-gas sensor is selected as the second operating point, and iii) an operating state of the internal combustion engine during which the exhaust gas sensor indicates large deviations at a detectable malfunction is selected as the second operating point.

4. The method as recited in claim 1, wherein the second operating point of the internal combustion engine is defined by one of: an engine speed, an injection quantity, an air mass, or an exhaust-gas recirculation state, considered in isolation or in a combination of variables in each case.

5. The method as recited in claim 1, wherein at least one of: i) the internal combustion engine is operated in trailing-throttle operation in the first operating point, and ii) the internal combustion engine is operated under partial loading in the second operating point.

6. The method as recited in claim 1, wherein the determining whether the exhaust-gas sensor is operating properly in the first operating point of the internal combustion engine takes place during an operating phase of the internal combustion engine, which is requested to implement a learning function for one of the exhaust-gas sensor or for a further sensor.

7. The method as recited in claim 1, wherein the internal combustion engine is in a hybrid vehicle.

8. A device for inferring a faulty or properly functioning exhaust-gas sensor in an exhaust duct of an internal combustion engine, comprising:

a control unit assigned to the internal combustion engine and the exhaust-gas sensor to control the internal combustion engine and to analyze output signals of the exhaust-gas sensor, wherein the control unit has a processor and a memory to perform the following:

operating, via the control unit, the internal combustion engine in a first operating point, wherein the internal combustion engine is operated in a trailing-throttle operation, and wherein the trailing throttle operation is not provided during regular operation of the internal combustion engine and is requested separately to implement a trailing-throttle adaptation of the exhaust gas sensor, which is a wideband lambda oxygen sensor;

performing a first function control of the wideband lambda oxygen sensor during the trailing-throttle operation which is suitable for functionally controlling the wideband lambda oxygen sensor;

monitoring, via the control unit, the exhaust-gas sensor in the first operating point;

determining, via the control unit in the first function control, whether the exhaust-gas sensor is operating properly in the first operating point;

if it is determined that the exhaust gas sensor is operating properly, operating, via the control unit, the internal combustion engine under partial load in at least one second operating point, wherein the second operating point is activated in a selective manner or is detected during regular operation of the internal combustion engine;

monitoring, via the control unit, the exhaust-gas sensor in the at least one second operating point, if the exhaust-gas sensor is operating properly;

determining and storing, via the control unit, as a learned value, an output signal of the exhaust-gas sensor or a characteristic quantity derived therefrom in the at least one second operating point;

assigning, via the control unit, an upper and a lower threshold value to the learned value;

comparing, via the control unit, the output signal of the exhaust-gas sensor or the characteristic quantity derived therefrom to the learned value during a subsequent operation of the internal combustion engine in the second operating point; and inferring, via the control unit, a faulty exhaust-gas sensor if the output signal of the exhaust-gas sensor or the characteristic quantity derived therefrom exceeds the upper threshold value or drops below the lower threshold value.

9. The device as recited in claim 8, wherein the internal combustion engine is in a hybrid vehicle.

10. The device as recited in claim 8, wherein there is a faulty exhaust-gas sensor if a faulty exhaust-gas sensor is detected repeatedly in successive monitoring phases.

11. The device as recited in claim 8, wherein the second operating point is at least one of the following: i) an operating state of the internal combustion engine which is activated frequently, ii) an operating state of the internal combustion engine which is activated for a sufficiently long period of time to monitor the exhaust-gas sensor, and iii) an operating state of the internal combustion engine during which the exhaust gas sensor indicates large deviations at a detectable malfunction.

12. The device as recited in claim 8, wherein the second operating point of the internal combustion engine is defined by one of an engine speed, an injection quantity, an air mass, or an exhaust-gas recirculation state, considered in isolation or in a combination of variables in each case.

13. The device as recited in claim 8, wherein the internal combustion engine is operated in at least one of the following states: i) a trailing-throttle operation in the first operating point, and ii) an under partial loading operation in the second operating point.

* * * * *